US011355095B2

(12) United States Patent
Hochfield

(10) Patent No.: US 11,355,095 B2
(45) Date of Patent: Jun. 7, 2022

(54) MIXER APPARATUS

(71) Applicant: EVERYTONE LIMITED, Glasgow Strathclyde (GB)

(72) Inventor: Barry Hochfield, Glasgow Strathclyde (GB)

(73) Assignee: DALSERF CONSULTING LIMITED, Glasgow (GB)

( * ) Notice: Subject to any disclaimer, the term of this patent is extended or adjusted under 35 U.S.C. 154(b) by 125 days.

(21) Appl. No.: 16/967,723

(22) PCT Filed: Feb. 7, 2019

(86) PCT No.: PCT/GB2019/050339
§ 371 (c)(1),
(2) Date: Aug. 5, 2020

(87) PCT Pub. No.: WO2019/155221
PCT Pub. Date: Aug. 15, 2019

(65) Prior Publication Data

US 2021/0074253 A1 Mar. 11, 2021

(30) Foreign Application Priority Data

Feb. 7, 2018 (GB) ..... 1802020

(51) Int. Cl.
*G10H 3/18* (2006.01)

(52) U.S. Cl.
CPC ..... *G10H 3/186* (2013.01); *G10H 3/182* (2013.01); *G10H 2220/461* (2013.01)

(58) Field of Classification Search
CPC ... G10H 3/186; G10H 3/182; G10H 2220/461
(Continued)

(56) References Cited

U.S. PATENT DOCUMENTS 4,480,520 A * 11/1984 Gold ..... G10H 3/182 84/735
4,598,418 A * 7/1986 Griffith, Jr. ..... H03G 3/001 381/83

(Continued)

FOREIGN PATENT DOCUMENTS

EP 2639787 9/2013
WO 2012/058495 5/2012

OTHER PUBLICATIONS

International Search Report for International Application No. PCT/GB2019/050339.

*Primary Examiner* — Christina M Schreiber
(74) *Attorney, Agent, or Firm* — Liu & Liu

(57) ABSTRACT

The present invention relates to a mixer apparatus (30) for mixing audio signals from a musical instrument (10). The mixer apparatus (30) comprises plural input circuits (34) and an audio signal mixer (36). Each of the plural input circuits (34) has an audio signal input which, in use, is coupled electrically with and thereby receives an audio signal from a different one of plural musical instrument pickups (32) comprised in the musical instrument. The audio signal mixer (36) receives audio signals from the plural input circuits (34) and mixes the received audio signals with one another. Each of the plural input circuits (34) comprises a linear active circuit in an audio signal path between the audio signal input and the audio signal mixer (36).

16 Claims, 4 Drawing Sheets

(58) Field of Classification Search
USPC ..... 381/118
See application file for complete search history.

(56) References Cited

U.S. PATENT DOCUMENTS

| | | | | | |
|---|---|---|---|---|---|
| 5,136,919 | A * | 8/1992 | Wolstein | G10H 1/08 | 84/735 |
| 5,189,241 | A * | 2/1993 | Nakamura | G10H 3/181 | 84/728 |
| 5,866,834 | A * | 2/1999 | Burke | G10H 1/46 | 84/622 |
| 6,627,808 | B1 * | 9/2003 | Coats | G10H 3/146 | 84/723 |
| 7,994,413 | B2 * | 8/2011 | Salo | G10H 3/181 | 84/726 |
| 9,070,353 | B2 * | 6/2015 | Gross | G10H 3/182 | |
| 9,196,235 | B2 * | 11/2015 | Ball | G10H 1/18 | |
| 9,286,874 | B1 * | 3/2016 | Micek | G10H 1/08 | |
| 2017/0084262 | A1 * | 3/2017 | Selmo | H03F 3/183 | |
| 2020/0135157 | A1 * | 4/2020 | Iori | G10D 1/085 | |
| 2021/0074253 | A1 * | 3/2021 | Hochfield | G10H 3/182 | |

* cited by examiner

MIXER APPARATUS

FIELD OF THE INVENTION

The present invention relates to a mixer apparatus for mixing audio signals from a musical instrument, such as an electric guitar. The present invention also relates to a musical instrument, such as an electric guitar, comprising such a mixer apparatus.

BACKGROUND ART

It is known to provide for connection and control of audio signals from pickups of an electric guitar. Connection and control is typically by way of an array of manually operable switches and potentiometers. Designs for electric guitars are such that they belong for the most part to a first group for which guitar pickups are typically connected in series or to a second group for which guitar pickups are typically connected in parallel. Known approaches to connection and control of audio signals are therefore usually limited in respect of breadth of changeability of tonal quality without resorting to modification of the pickups themselves, such as by modifying how the coils of magnetic pickups are connected to one another or by tapping off the coils, or without having an approach to manual control which is unduly burdensome.

Mindful of the shortcomings of known approaches to connection and control of audio signals from pickup equipped musical instruments, such as electric guitars, the present inventors have devised an improved approach to audio signal control which provides for an increased breath of changeability of tonal quality of audio signals.

It is therefore an object for the present invention to provide an improved control apparatus for controlling audio signals from a musical instrument and in particular but not exclusively from an electric guitar.

It is a further object for the present invention to provide a musical instrument, such as an electric guitar, comprising improved control apparatus for controlling audio signals from the musical instrument.

STATEMENT OF INVENTION

According to a first aspect of the present invention there is provided a mixer apparatus for mixing audio signals from a musical instrument, the mixer apparatus comprising:

- plural input circuits, each of the plural input circuits having an audio signal input which, in use, is coupled electrically with and thereby receives an audio signal from a different one of plural musical instrument pickups comprised in the musical instrument; and
- an audio signal mixer receiving audio signals from the plural input circuits and mixing the received audio signals with one another,
- each of the plural input circuits comprising a linear active circuit in an audio signal path between the audio signal input and the audio signal mixer.

The mixer apparatus for mixing audio signals from a musical instrument, such as an electric guitar, comprises plural input circuits. Each of the plural input circuits has an audio signal input. In use, each audio signal input is coupled electrically with and thereby receives an audio signal from a different one of plural musical instrument pickups comprised in the musical instrument. The audio signal input may be electrically coupled directly to the musical instrument pickup. The audio signal input may be coupled to the musical instrument pickup without any electronic component and more specifically active electronic component in between. The audio signal input may be configured accordingly. The audio signal input may comprise an electrical connector which is configured to make an electrical connection with an output from the musical instrument pickup. The mixer apparatus further comprises a mixer. The audio signal mixer receives audio signals from the plural input circuits and mixes the received audio signals with one another. There may be no electronic component and more specifically no active electronic component in the audio signal path between each input circuit and the audio signal mixer. In forms of the invention, the mixer apparatus may comprise the plural musical instruments pickups.

Each of the plural input circuits comprises a linear active circuit in an audio signal path between the audio signal input and the audio signal mixer. The linear active circuit may have a transfer function which is substantially linear. Although the linear active circuit might be operative in a non-linear mode without other circuitry of the input circuit, for example when saturated, audio signals are passed from the audio signal input to the mixer by way of the linear active circuit when the linear active circuit is operative in a linear mode. The linear active circuit may comprise at least one semiconductor device. Each of the plural input circuits may therefore receive an analogue audio signal from the musical instrument pickup and provide an analogue audio signal to the audio signal mixer with substantially no distortion or at least distortion that is insufficient for perception. The thus described mixer apparatus provides for mixing of audio signals in series and parallel modes as is described below and without relying on mechanical adjustment by way of manually operable switches or potentiometers.

The input circuit may be configured to present a high impedance to the musical instrument pickup. Presenting a high impedance to a musical instrument pickup may be beneficial to the quality of sound produced by the musical instrument pickup. The input circuit may comprise an input circuit amplifier which may be configured to be operative as a buffer amplifier. An audio signal received at the audio signal input may be received at an input to the input circuit amplifier. The input circuit amplifier may be configured to be operative as a voltage buffer. The input circuit amplifier may be configured as a non-inverting amplifier having substantially unity gain. The input circuit amplifier may comprise an op-amp.

The input circuit may further comprise a second input circuit amplifier which receives an audio signal from the audio signal input and provides an audio signal output which is the other of inverted and not inverted when the first input circuit amplifier provides an audio signal output which is one of inverted and not inverted. For example, where the first input circuit amplifier is non-inverting, the second input circuit amplifier is inverting. The second input circuit amplifier may receive an audio signal from an output from the first input circuit amplifier whereby the second input circuit amplifier receives the audio signal from the audio signal input by way of the first input circuit amplifier. The second input circuit amplifier may be operative as a buffer amplifier. The second input circuit amplifier may be configured to be operative as a voltage buffer. The second input circuit amplifier may be configured as an inverting amplifier having unity gain. The second input circuit amplifier may comprise an op-amp. The mixer apparatus therefore provides two buffered voltage signals which each correspond substantially to the audio signal received at the audio signal input with a first one of the two buffered voltage signals being non-inverted and a second one of the two buffered voltage signals being inverted.

The input circuit may yet further comprise a first phase mixer circuit which receives an audio signal from each of the first and second input circuit amplifiers and provides a first phase mixer circuit output signal which is a combination of the audio signals from the first and second input circuit amplifiers. The first phase mixer circuit may provide for change in proportion of each of the audio signals from the first and second input circuit amplifiers in the first phase mixer circuit output signal. The first phase mixer circuit may be digitally controlled to change the proportion of the audio signals in the first phase mixer circuit output signal. The first phase mixer circuit may comprise a digital potentiometer. The digital potentiometer may be connected at one end to the output from the first input circuit amplifier and may be connected at the other end to the output from second input circuit amplifier. A 'wiper' of the digital potentiometer may provide an input to the summing circuit described below. The first phase mixer circuit may provide for progressive change from the first phase mixer circuit output signal consisting substantially of the audio signal from the first input circuit amplifier when in a first condition to consisting substantially of the audio signal from the second input circuit amplifier when in a second condition. When in one of plural further conditions between the first and second conditions, the first phase mixer circuit may mix the audio signals from the first and second input circuit amplifiers in substantially the same proportions whereby the audio signals substantially cancel each other. The first phase mixer circuit output signal may therefore be substantially zero when in this one further condition. A pickup may thus be deselected.

It is known to connect musical instrument pickups in phase and out of phase with each other, for example where there are two pickups, pickup 1+pickup 2 or pickup 1−pickup 2, i.e. 0 degrees phase difference or 180 degrees phase difference. It is known for electric guitars to select between pickups being full in and fully out of phase by way of phase inversion switches. Fully out of phase, i.e. 180 degrees out of phase, is often perceived as thin sounding, i.e. lacking in harmonic amplitude. The present phase mixer circuit provides for variation between these two extremes by audio signals from two pickups being partially in or out of phase with each other. A richer harmonic content may thus be obtained when the audio signals from the two pickups are mixed. Furthermore, this approach may provide an increased range of tonal content from which selection may be made by controlling the first phase mixer circuits that are associated with their respective pickups.

The audio signal mixer may comprise a summing circuit which receives an audio signal from each of the plural input circuits and provides a summed audio signal. As described above, each of the audio signals from the plural input circuits may be a voltage signal. More specifically, the summing circuit may receive an audio signal from each of the plural first phase mixer circuits. The summing circuit may therefore sum the voltage signals in a series mode of operation whereby series connection of musical instrument pickups is emulated. The first phase mixer circuit may be controlled as described above whereby no audio signal from an input circuit is provided to the summing amplifier. Furthermore, the first phase mixer circuit may be operated such that an output from a pickup is partially in series. It is known to connect musical instrument pickups themselves in series. For example, the signature pickup design of the Gibson brand of electric guitar, namely the Humbucker pickup, involves a dual coil and magnet assembly inside the same case with the two magnets in the assembly being of opposite polarity. The coils of the Humbucker pickup are connected in series. When coils are connected in series the tone is perceived as being thicker aside from the doubling of peak output voltage. The present approach provides for emulation of series connection without modification of the magnetic pickups themselves. Considering the Gibson brand further, two dual coil pickups (i.e. four coils) are provided. In theory, fifteen different configurations are possible for the Gibson brand. However, in practice only three different configurations are provided. The present approach provides for expansion beyond the usually available three different configurations.

The summing circuit may be configured to present a high impedance to each input circuit. The summing circuit may comprise a summing circuit amplifier which may be configured to be operative as a buffer amplifier. The summing circuit amplifier may be configured to be operative as a voltage buffer. The summing circuit amplifier may be configured as an inverting amplifier having unity gain. The summing circuit amplifier may comprise an op-amp.

The input circuit may further comprise a second phase mixer circuit which receives an audio signal from each of the first and second input circuit amplifiers and provides a second phase mixer circuit output signal which is a combination of the audio signals from the first and second input circuit amplifiers. The second phase mixer circuit may comprise one or more features of the first phase mixer circuit described above. As described below, the presence of the second phase mixer circuit provides for parallel and series emulation at the same time.

The audio signal mixer may further comprise a voltage to current converter for each input circuit. The voltage to current converter may receive an audio signal from at least one of the first input circuit amplifier and the second input circuit amplifier and provide a corresponding current signal. More specifically, the voltage to current converter may receive an audio signal from the second phase mixer circuit. The corresponding current signal may be applied to the input to the input circuit and more specifically to an input of the first input circuit amplifier. As described below, the musical instrument pickups may be common referenced. The voltage to current converter may therefore be configured to providing a floating current signal. The voltage to current converter may have a Howland or a modified Howland current pump configuration. The Howland or modified Howland current pump may have a two op-amp configuration. The op-amp in the feedback loop of the Howland or the modified Howland current pump may shield the resistors in the feedback path from the input signal to the Howland current pump.

The audio signal mixer may further comprise a switch arrangement for each input circuit. The switch arrangement may have a switch input and plural switch outputs. The switch input may receive the corresponding current signal from the voltage to current converter. Each of the plural switch outputs may provide a signal path to a different one of the other input circuits comprised in the mixer apparatus. A further switch output may provide a signal path to circuit common whereby the corresponding current signal is not applied to any of the other input circuits. The switch arrangement may be digitally controlled. The switch arrangement may therefore be used to selectively apply the corresponding current signal to one of the other input circuits whereby the corresponding current signal is summed with the current signal from the other input circuit's musical instrument pickup. The plural voltage to current converters and switch arrangements may therefore provide for summing of current signals in a parallel mode of operation whereby parallel connection of musical instrument pickups is emulated. It is known to connect musical instrument pickups themselves in parallel. For example, magnetic pickups in the Fender brand of electric guitar are normally of single coil design which are connected in parallel with one another. The present approach provides for emulation of parallel connection without modification of magnetic pickups themselves. Furthermore, the second phase mixer circuit may be operated such that an output from a pickup is partially in parallel or deselected when the two opposite phase audio signals from the second phase mixer circuit cancel each other. Considering the Fender Stratocaster, three single coil pickups are provided. In theory, seven different configurations are possible for the Fender Stratocaster. However, in practice only five different configurations are provided. The present approach provides for expansion beyond the usually available five different configurations.

As described above, series or parallel emulation may be provided for by way of the present apparatus. Furthermore, the present mixer apparatus may be configured, for example, by way of digital control to provide for series and parallel emulation at the same time in accordance with various combinations in respect of the plural musical instrument pickups. A wide range of different combinations may thus be provided by way of the present apparatus. In contrast, a limited subset of combinations is provided for in known apparatus.

The mixer apparatus may further comprise a gain stage which receives an audio signal from the audio signal mixer and more specifically from the summing circuit. The gain stage may comprise a first variable gain circuit which receives an audio signal from the audio signal mixer and more specifically from the summing circuit. The first variable gain circuit may be inverting if the summing circuit is inverting. The first variable gain circuit may comprise an op-amp and more specifically an op-amp comprised in an inverting amplifier. At least one of a feedback resistor and a resistor in series with an inverting input of the op-amp may be of variable resistance. More specifically, the inverting amplifier may comprise a digital potentiometer with a first end of the digital potentiometer in a feedback loop of the op-amp, a second end of the digital potentiometer electrically coupled to one of an output from the summing circuit and a resistor in series with an inverting input of the op-amp, and a 'wiper' of the digital potentiometer electrically coupled to the inverting input of the op-amp. The digital potentiometer may be digitally controlled. The first gain circuit may be configured by way of selection of resistance values to provide for fine volume control, such as between −12 dBV and +12 dBV.

The gain stage may further comprise a second variable gain circuit which receives an audio signal from the first variable gain circuit. The second variable gain circuit may comprise a variable voltage divider. The variable voltage divider may comprise a variable resistor and more specifically a digital potentiometer. The digital potentiometer may be digitally controlled. A first end of the digital potentiometer may be electrically coupled to an output from the first variable gain circuit and a second end of the digital potentiometer may be electrically coupled to circuit common. A 'wiper' of the digital potentiometer may be an output from the variable voltage divider. The variable voltage divider may comprise a voltage divider resistor between the 'wiper' of the digital potentiometer and circuit common to thereby make operation of the variable voltage divider non-linear. The second variable gain circuit may be configured by way of resistance values to provide for coarse volume control. The second variable gain circuit may further comprise a voltage follower at the output from the variable voltage divider.

The mixer apparatus may comprise a peak detector circuit. An output from the audio signal mixer may be received as an input by the peak detector circuit. An output from the peak detector circuit may be received in an analogue-to-digital converter to thereby provide a digital representation of a sampled peak value. The mixer apparatus may therefore comprise an analogue-to-digital converter. The digital representation of the sampled peak value may be processed to determine if the output from the audio signal mixer should be amplified or attenuated. Processing may be by way of a processor, such as a microcontroller. The processor may be comprised in the mixer apparatus. The gain of the gain stage may be controlled in dependence on the determination made by the processor. The processor may therefore control the gain stage either directly or by way of a bus, such as an I2C bus.

The mixer apparatus may comprise active electronic components, such as op-amps, which may be put into a low power state. More specifically, the mixer apparatus may be configured to cut power supply to at least one such active electronic component. Alternatively or in addition, at least one such active electronic component may be configured itself to enter a low power mode. The mixer apparatus may be configured to cut power supply when no signal or when a signal no greater than a predetermined threshold is received from any musical instrument pickup over a predetermined period. Furthermore, the mixer apparatus may comprise a wake-up circuit which changes such active electronic components from the low power state to an operative state. The wake-up circuit may comprise an amplifier, such as an op-amp based amplifier, which receives an output from at least one of the musical instrument pickups as an input. An output from the wake-up circuit may be subject to threshold detection and active electronic components in the low power state may be powered up in dependence on an outcome of the threshold detection. The threshold detection may be performed and change from the low power state may be controlled by a processor.

The musical instrument pickup may have first and second output terminals. The musical instrument pickup may be a one port device. The first output terminal may be electrically connected to the audio signal input. The second output terminal may be electrically connected to common and more specifically to a circuit common defined by the mixer apparatus. The audio signal produced by each of the plural musical instrument pickups may therefore be common referenced. The musical instrument pickup may be a current output sensor. The input circuit may comprise an input circuit impedance element and more specifically an input circuit resistor between the audio signal input and circuit common, i.e. in parallel with the musical instrument pickup. A current signal provided by the current output sensor may be developed as a voltage signal across the input circuit impedance element. The musical instrument pickup may be one of a magnetic pickup and a microphonic pickup.

An impedance of the input circuit impedance element may be changed, for example, by way of computer control. The input circuit impedance element may therefore be a variable resistor and more specifically a digital variable resistor. Changing the impedance presented by the variable resistor may change the potential developed across the variable resistor by operation of the musical instrument pickup whereby the peak to peak voltage of the voltage signal, which corresponds to the audio signal from the musical instrument pickup and which is seen by the input circuit, is changed.

In one form, the mixer apparatus may be configured to be attached and more specifically removably attached to an interior of the musical instrument, such as an electric guitar. The mixer apparatus may therefore not form part of the musical instrument as manufactured and may be bought and sold separately. The mixer apparatus may be brought into use when required and removed from the musical instrument when no longer required. When it has been brought into use, the mixer apparatus may be contained within an existing space in the musical instrument. In another form, the mixer apparatus may be comprised in a musical instrument, such as an electric guitar, and more specifically may be irremovably attached to the musical instrument. The mixer apparatus may therefore form part of the musical instrument as manufactured.

The musical instrument may be brought into use by connecting the musical instrument to a loudspeaker arrangement. Usually, connection to a loudspeaker arrangement is by way of at least one amplifier such as a preamplifier and a power amplifier. The audio signal from the mixer apparatus may thus be amplified to an extent sufficient to drive the loudspeaker arrangement. In particular but not exclusively, where the musical instrument is portable, for example when the musical instrument is an electric guitar, it may be advantageous for the mixer apparatus to be battery powered. The mixer apparatus may therefore comprise a battery and more specifically a rechargeable battery. A rechargeable battery needs to be recharged from time to time. An electrical connector for the audio signal output from the mixer apparatus may be configured to provide for charging of the rechargeable battery as described below.

The mixer apparatus may comprise an audio signal output connector which is electrically coupled to an output from circuitry of the mixer apparatus, such as an output from the gain stage. The audio signal output connector may provide a means of electrically connecting the mixer apparatus to further audio apparatus, such as a power amplifier, by way of a lead. The audio signal output connector may be a socket. The audio signal output connector may be a stereo signal connector of a kind often comprised in musical instruments having pickups. A stereo signal connector, such as a stereo jack, comprises three electrical terminals, namely a circuit common, and first and second audio terminals. Playing the musical instrument by way of the present mixer apparatus requires two electrical terminals only, namely circuit common and one audio terminal. The mixer apparatus may therefore comprise a second audio signal output connector which is configured to electrically connect with the first audio signal output connector. For example, the second audio signal output connector may be a jack plug where the first audio signal output connector is a jack socket. The second audio signal output connector may be a three-terminal device with each of the three terminals making an electrical connection with a respective one of the three terminals of the first audio signal output connector. A first terminal on each of the first and second audio signal output connectors may be a circuit common and a second terminal on each of the first and second audio signal output connectors may be an audio signal terminal. The first and second terminals may be for carrying the audio signal from the mixer apparatus to, for example, an amplifier. A third terminal on each of the first and second audio signal output connectors may be a charge voltage terminal. The first and third terminals may be for carrying a charging current from a power supply, which is connected to the second audio signal output connector, to the rechargeable battery comprised in the mixer apparatus.

The mixer apparatus may comprise a first adaptor, which constitutes the second audio signal output connector. The first adaptor may be configured to connect electrically with the first audio signal output connector, such as by way of a stereo jack plug. Furthermore, the first adaptor may be configured to connect electrically to a lead having a single audio signal conductor and circuit common, such as by way of a mono jack plug whereby the first adaptor provides for connection to further audio apparatus, such as an amplifier. The first adaptor may be further configured to connect electrically to a power supply, such as by way of a micro-USB connector. The first adaptor may be used for charging of the battery while the musical instrument is played.

The mixer apparatus may comprise a second adaptor, which constitutes the second audio signal output connector. The second adaptor may be configured to connect electrically with the first audio signal output connector, such as by way of a stereo jack plug. Furthermore, the second adaptor may be configured to connect electrically to a power supply, such as by way of a micro-USB connector, by way of respective first and third terminals in the first audio signal output connector and the second adaptor. Otherwise, the second adaptor lacks a second terminal for coupling of the audio signal from the mixer apparatus. The second adaptor may be used for charging of the battery only when the musical instrument is not being played.

Should the mixer apparatus be used when there is no need for charging of the battery, the second audio signal output connector may be a two-terminal device, such as a mono jack plug, of known form to provide for connection of the mixer apparatus to further audio apparatus, such as a loudspeaker.

As described above, the mixer apparatus may be digitally controlled. The mixer apparatus may therefore comprise a processor, such as a microcontroller. The mixer apparatus may further comprise support circuits, such as electronic memory, an analogue-to-digital converter where such is not comprised in the processor, and power supply regulation circuits. Digital control and the presence of a processor may provide for instantaneous control of the mixer apparatus. At least one of the controllable functions described above, such as series mode and parallel mode operation, may be changed instantaneously. For example, a proportion of each of the audio signals from the first and second input circuit amplifiers may be changed progressively by the phase mixer circuit at a constant rate of change or perhaps even at a varying rate of change. Such control may provide modulation effects which further enrich the capabilities of the mixer apparatus.

Digital control of the mixer apparatus may provide for ease of control by a user by way of a software interface. The mixer apparatus may therefore comprise computing apparatus which provides a software interface, such as an App, for control of the mixer apparatus. The computing apparatus may be portable computing apparatus, such as a laptop computer, and more specifically hand portable computing apparatus, such as a tablet computer or a smartphone. Communication between the computing apparatus and the electronic circuitry of the mixer apparatus may be wireless, such as by way of a Bluetooth or WiFi communication channel. The mixer apparatus may be configured appropriately in respect of comprising a transceiver configured for communication in accordance with the Bluetooth or WiFi standard.

The computing apparatus, for example tablet computer or smartphone, may already comprise a Bluetooth or WiFi transceiver.

Control of the mixer apparatus by way of the computing apparatus may depend on a configuration of the pickups of the musical instrument being known. For example, as described above, the Gibson and Fender brands have generally different configurations. Furthermore, different models of each brand may be differently configured. The software interface may therefore provide plural different musical instrument configurations from which a user selects by operation of the software interface. For example, the plural different musical instrument configurations may be presented in a drop-down list, such as in the form of electric guitar make and model.

The plural different musical instrument configurations may be conveyed to the computing apparatus from a remote location, such as by way of the Internet. More specifically, the plural different musical instrument configurations may be conveyed to the computing apparatus from a central computing apparatus. The central computing apparatus may store a library of musical instrument configurations. The mixer apparatus may comprise the central computing apparatus. The central computing apparatus may be operated by or on behalf of a vendor, such as the vendor of the software interface that runs on the computing apparatus local to the mixer apparatus. A user of the local computing apparatus may gain access to the central computing apparatus by operation of the software interface to initially create a user account for proper use of the software interface and subsequently to regain access to the central computing apparatus in respect of data stored in the central computing apparatus and, as described below, of storage of data in the central computing apparatus. Creation of a user account and access to the user account may be in accordance with known practice.

The software interface may be operative to present an image of a musical instrument with which the mixer apparatus is to operate. The image of the musical instrument may be presented on a display of the local computing apparatus. The image of the musical instrument may be presented in dependence on the previously described step of user selection from plural different musical instrument configurations. The software interface may be further operative to present pickups comprised in the image of the musical instrument in a fashion which differs from how the pickups are present in an actual musical instrument. For example, the pickups in the image may be of a different size, such as larger, relative to the musical instrument. By way of further example, the pickups in the image may be at a different location relative to the musical instrument, such as raised or floating above the location in the actual musical instrument. Each of the pickups in the image may be an object which is manipulable by a user independently of the rest of the image. More specifically, each object may be manipulable by manual interaction with the object as displayed, such as is provided by the image being displayed on a touchscreen. The software interface may be configured to translate different forms of manipulation of the object into different control data for controlling the mixer apparatus. As described above, series emulation, parallel emulation, phase and gain may be controlled. The different control data may comprise control data in respect of at least one of series emulation, parallel emulation, phase and gain. The different forms of manipulation may comprise the like of rotation of the object, pressing the object, linear translation of the object and changing the shape of the object, such as stretching or contracting the object along at least one of two orthogonal axes or rotating the object around an axis.

The musical instrument apart from the mixer apparatus may comprise at least one manually operable control, such as a switch or control knob. Where the musical instrument comprises at least one manually operable control, the mixer apparatus may be configured to be operative in dependence on operation of the at least one manually operable control. For example, the mixer apparatus may be configured in respect of a first manually operable control for master volume and in respect of a second manually operable control for master tone, such as in the form of low pass roll off.

The mixer apparatus may comprise a primary manually operable control and more specifically an encoder. The encoder may be rotatably controlled. The encoder may comprise at least one light source which provides a visible output which changes to reflect a change in position of the encoder. In use, the primary manually operable control may replace a manually operable control comprised in the musical instrument, e.g. a manually operable control that is part of the musical instrument upon manufacture. The mixer apparatus may be configured such that the primary manually operable control is operable to make selections from predetermined configurations for the musical instrument, for example, from predetermined patches where the musical instrument is a guitar. By way of example and where the musical instrument is a guitar having three single coils, a first position of the primary manually operable control may be used to select: 1=neck coil; 2=neck coil in parallel with mid coil; 3=mid coil; 4=mid coil in parallel with bridge coil; and 5=bridge coil. By way of further example, a second position of the primary manually operable control may be used to select: 1=neck coil in series with mid coil; 2=neck coil in series with bridge coil; 3=mid coil in series with neck coil; 4=all three coils in series; and 5=all three coils in series with parametric equalisation mid boost of 5 db. By way of further example, a third position of the primary manually operable control may be used to select: 1=neck coil in 50/50 series/parallel with mid coil at 90 degrees phase; 2=neck coil 50/50 series/parallel with bridge coil at 90 degrees phase; 3=neck coil 50/50 series/parallel with mid coil at 90 degrees phase, and mid coil 50/50 with bridge; 4=neck coil 75/25 series/parallel with mid coil at 135 degrees phase, and mid coil 50/50 with bridge; and 5=neck coil 50/50 series/parallel with bridge coil at 135 degrees phase, and mid coil 25/75 with bridge.

The local computing apparatus may be configured to acquire an image of a musical instrument with which the mixer apparatus is to operate. The image may be acquired by way of a camera comprised in the local computing apparatus. The software interface may be operable to personalize the image of a musical instrument with which the mixer apparatus is to operate. For example, a colour scheme of the musical instrument in the acquired image may be abstracted from the musical instrument and incorporated in the image of a musical instrument with which the mixer apparatus is to operate. The software interface may be operable to display an outline of the musical instrument on a display of the local computing apparatus. The outline of the musical instrument may be selected in dependence on the previously described step of user selection from plural different musical instrument configurations. An outline having a shape corresponding to the actual musical instrument may thus be displayed on the display of the local computing apparatus. A user may position the local computing apparatus whereby the displayed outline is in registration with an image of the actual musical instrument acquired by the local computing apparatus and displayed on the display. An image of the musical instrument which is stored in the local computing apparatus may therefore be operated on properly by the software interface as a consequence of registration to abstract appropriate data from the stored image, such as in respect of the colour scheme of the musical instrument.

The mixer apparatus may be configured by way of the software interface and digital control to select from the plural musical instrument pickups connected to the mixer apparatus. Where the number of musical instrument pickups is n, the number of different selections is 2n−1. Selection may be by way of passing an audio signal from a musical instrument pickup for mixing. According to one approach, at least one of the first and second phase mixer circuits may be controlled such that the two audio signals of opposite phase cancel each other. According to another approach and where the input circuit impedance element is a variable resistor, the variable resistor may be controlled such that it has a resistance of zero whereby no potential is developed across the input circuit impedance element and no audio signal corresponding to the pickup output signal is passed to the input circuit.

The mixer apparatus may be configured by way of the software interface and digital control to select how at least two musical instrument pickups are, in effect, connected to one another. For example, first and second pickups may be connected in phase with each other such that one has pickup 1+pickup 2 or out of phase with each other such that one has pickup 1−pickup 2, i.e. changing between in and out of phase involves reversing one of the two pickups. Furthermore, phasing between pickups may be set between in and out of phase. Selection of how at least two musical instrument pickups are, in effect, connected to one another may be by control of at least two first phase mixer circuits and the summing circuit.

The mixer apparatus may be configured by way of the software interface and digital control to determine effective relative orientation of at least two musical instrument pickups in respect of emulation of extent of at least one of series connection and parallel connection. Determining effective relative orientation of at least two musical instrument pickups may be by control of one of: at least two first phase mixer circuits and the summing circuit; and at least two first phase mixer circuits, at least two second phase mixer circuits, the switch arrangement and the summing circuit.

The local computing apparatus may be operative under control of the software interface to store at least one configuration of the mixer apparatus, such as at least one of the configurations described above. Storage of a configuration may provide for its subsequent ease of use. The local computing apparatus may convey at least one stored configuration to the central computing apparatus. A stored configuration may be retrieved later from the central computing apparatus.

The central computing apparatus may store a reference configuration for at least one musical instrument of the same kind as but different form to the musical instrument operable with the mixer apparatus. The software interface may be operable to provide for the reference configuration being conveyed from the central computing apparatus to the local computing apparatus. The reference configuration may control the mixer apparatus such that the mixed audio signal from the mixer apparatus sounds like it is from a musical instrument of different form to the musical instrument operating with the mixer apparatus. A reference configuration may be formed by: acquiring a first audio signal from the musical instrument operable with the mixer apparatus in response to a predetermined excitation; acquiring a second audio signal from the other musical instrument of the same kind but different form in response to the predetermined excitation; comparing the first and second audio signals to determine how to make the first audio signal sound like the second audio signal; and forming reference configuration in dependence on the determination. The first and second audio signals may be compared by way of a correlation approach.

Where the mixer apparatus comprises a central computing apparatus, one or more further applications may be supported. The central computing apparatus may be in communication with plural mixer apparatus of the form described herein with the plural mixer apparatus being in different ownership at, most often, different locations. Each of the plural mixer apparatus may be identified by a unique code, such as a MAC address or IMEI number and hence may be recognised by the central computing apparatus. Furthermore, the unique code may be associated in the central computing apparatus with data pertaining to the respective mixer apparatus. As described above, a user account may be created for proper use of the software interface of the mixer apparatus.

According to a first further application, user account data comprised in the central computing apparatus may comprise the unique code. The user account data may further comprise information relating to the musical instrument with which the mixer apparatus is operable. The information relating to the musical instrument may comprise the like of a photograph of the musical instrument and a photograph of documents serving as proof of ownership of the musical instrument, such as a purchase receipt. The user account data may therefore serve to provide proof of ownership of the musical instrument. The central computing apparatus may be configured to regulate transfer of ownership of the musical instrument by controlling access to the user account by the present and future owners. Such an approach may be useful where the seller and buyer are remote from each other. More specifically, the process may involve the seller sending the musical instrument to the buyer and the seller retaining control of the user account until payment for the musical instrument clears whereupon control of the user account is passed to the buyer.

As described above, communication between the local computing apparatus and the electronic circuitry of the mixer apparatus may be wireless, such as by way of a Bluetooth or WiFi communication channel. According to a second further application, the local computing apparatus and the electronic circuitry of the mixer apparatus may be configured for periodic wireless communication between the local computing apparatus and the electronic circuitry of the mixer apparatus whereby proximity of the electronic circuitry of the mixer apparatus and hence the musical instrument may be determined. If the musical instrument and hence the electronic circuitry of the mixer apparatus is moved, the local computing apparatus may be operative to determine that there has been no periodic wireless communication and to generate an alarm in dependence on this determination. The alarm may be output by the local computing apparatus. Alternatively or in addition, the alarm may be conveyed to the central computing apparatus. The software interface may provide for selection between generation of an alarm being enabled and generation of an alarm being disabled. For example, the former may be an 'away from home' mode and the latter may be an 'at home mode'.

According to a second aspect of the present invention, there is provided a musical instrument, such as an electric guitar, comprising the mixer apparatus according to the first aspect of the present invention. Embodiments of the second aspect of the present invention may comprise one or more features of the first aspect of the present invention.

The present inventors have appreciated the ability to charge the rechargeable battery while the musical instrument is being played to be of wider applicability than hitherto described. Therefore, and according to a third aspect of the present invention, there is provided an electric musical instrument comprising:

an audio circuit providing an audio signal in dependence on the electric musical instrument being played;

a rechargeable battery providing electrical power to the audio circuit;

a first audio signal output connector on the electric musical instrument, the first audio signal output connector having a first terminal being a circuit common, a second terminal receiving the audio signal from the audio circuit and a third terminal carrying a charging current to the rechargeable battery; and a second audio signal output connector which is configured to removably connect with the first audio signal output connector, the second audio signal output connector having first, second and third terminals which connect electrically with the first, second and third terminals respectively of the first audio signal connector.

The second audio signal output connector provides for a breakable connection being made to further audio apparatus, such as a power amplifier and loudspeaker, and to a power supply for recharging of the rechargeable battery. The second audio signal output connector may provide for connection to at least one lead. A first such lead may be a two-conductor lead, i.e. a lead having an audio signal conductor and circuit common conductor, for connection to further audio apparatus. A second such lead may be a two-conductor lead, i.e. a lead having a charging current conductor and circuit common conductor, for connection to a power supply. Further embodiments of the third aspect of the present invention may comprise one or more features of the first aspect of the present invention.

The present inventors have appreciated the ability to control the mixer apparatus by way of a manipulable object on a display of the computer apparatus to be of wider applicability than hitherto described. Therefore, and according to a fourth aspect of the present invention, there is provided a mixer apparatus comprising:

plural musical instrument pickups comprised in a musical instrument;

an audio signal mixer receiving audio signals from the plural musical instrument pickups and mixing the received audio signals with one another; and computer apparatus running a software interface, the software interface presenting an image on the computer apparatus of the musical instrument including the plural musical instrument pickups comprised in the musical instrument, the plural musical instrument pickups being presented as at least one user manipulable object in the image, manipulation of the user manipulable object being operative to control how the audio signals from the musical instrument pickups are mixed by the mixer apparatus.

Each at least one user manipulable object may be manipulable by manual interaction with the object as displayed, such by way of a touchscreen comprised in the computing apparatus. The software interface may be configured to translate different forms of manipulation of the object into different control data for controlling the mixer apparatus. As described above, series emulation, parallel emulation and gain may be controlled. The different control data may comprise control data in respect of at least one of series emulation, parallel emulation and gain. Further embodiments of the present aspect may comprise one or more features of the first aspect of the present invention.

According to a fifth aspect of the present invention there is provided a method of mixing audio signals from a musical instrument, the method comprising:

receiving in each of plural input circuits an audio signal from a different one of plural musical instrument pickups comprised in the musical instrument;

receiving audio signals from the plural input circuits in an audio signal mixer; and mixing the received audio signals with one another in the audio signal mixer, each of the plural input circuits comprising a linear active circuit in an audio signal path between the audio signal input and the audio signal mixer.

Embodiments of the fifth aspect of the present invention may comprise one or more features of the first aspect of the present invention.

According to a further aspect of the present invention there is provided a mixer apparatus for mixing audio signals from a musical instrument, the mixer apparatus comprising: plural input circuits, each of the plural input circuits having an audio signal input which, in use, is coupled electrically with and thereby receives an audio signal from a different one of plural musical instrument pickups comprised in the musical instrument; and an audio signal mixer receiving audio signals from the plural input circuits and mixing the received audio signals with one another.

Each of the plural input circuits may be configured to at least perform signal conditioning of an audio signal from one of plural musical instrument pickups. Signal conditioning may comprise at least one of: current to voltage conversion; charge to voltage conversion; filtering; and adjustment of the audio signal to line level.

The mixer apparatus may further comprise previously described features, such as the local computing apparatus and wireless communication between the local computing apparatus and the electronic circuitry of the mixer apparatus. The mixer apparatus may therefore be configured for periodic wireless communication between the local computing apparatus and the electronic circuitry of the mixer apparatus whereby presence of the electronic circuitry of the mixer apparatus and hence the musical instrument may be determined. Further features of this aspect of the mixer apparatus are described above. Otherwise, further embodiments of the present aspect may comprise one or more features of the first aspect of the present invention.

According to a yet further aspect of the present invention there is provided a method of mixing audio signals from a musical instrument, the method comprising: receiving in each of plural input circuits an audio signal from a different one of plural musical instrument pickups comprised in the musical instrument; receiving audio signals from the plural input circuits in an audio signal mixer; and mixing the received audio signals with one another in the audio signal mixer. Embodiments of the present aspect may comprise one or more features of the first or fifth aspect of the present invention.

BRIEF DESCRIPTION OF DRAWINGS

Further features and advantages of the present invention will become apparent from the following specific description, which is given by way of example only and with reference to the accompanying drawings, in which.

DESCRIPTION OF EMBODIMENTS

Figure 1:
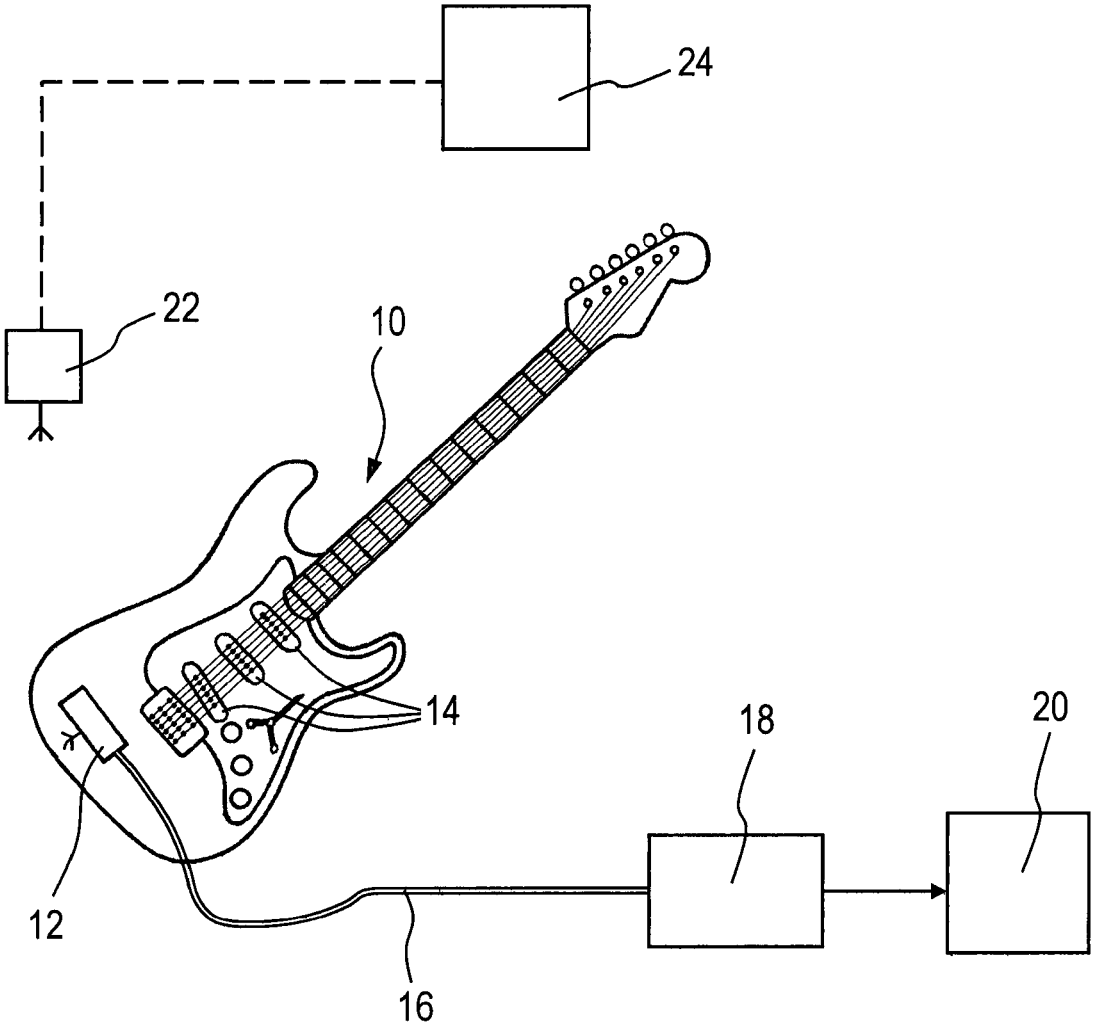
FIG. 1 is a representation of an electric guitar comprising a mixer apparatus according to the present invention.

A representation of an electric guitar 10 comprising a mixer apparatus 12 according to the present invention is shown in FIG. 1. The mixer apparatus 12 is mounted within the electric guitar 10. In the embodiment shown in FIG. 1 the mixer apparatus 12 is received in an existing space in the guitar, although the mixer apparatus may be mounted at any other location on the guitar which presents substantially no impediment to playing of the electric guitar. The mixer apparatus 12 is electrically powered by way of a rechargeable battery. Apart from the mixer apparatus 12, the electric guitar 10 is of conventional form and function. For example, the electric guitar 10 comprises three magnetic pickups 14 with each magnetic pickup at a respective one of bridge, middle and neck locations. Although not shown in FIG. 1, the mixer apparatus 12 is electrically connected by way of copper connections to each of the three magnetic pickups 14 whereby the mixer apparatus receives audio signals from all three of the magnetic pickups. Where the mixer apparatus 12 is retrofitted to the guitar, the mixer apparatus is electrically connected to the magnetic pickups 14 by re-soldering or re-wiring. As shown in FIG. 1, the mixer apparatus 12 is electrically connected by way of a lead 16 to a preamplifier and power amplifier 18 which in turn is electrically connected to a loudspeaker arrangement 20. The preamplifier and power amplifier 18 and the loudspeaker arrangement 20 are of conventional form and function. The mixer apparatus 12 comprises a Bluetooth or WiFi transceiver which provides for short range wireless communication with local computing apparatus 22 in the form of a tablet computer, smartphone or the like. As described below, the local computing apparatus 22 provides for control of the mixer apparatus 12. A central computing apparatus 24 is in wireless communication with the local computing apparatus 22 such as by way of the Internet. The central computing apparatus 24 is operated by or on behalf of a vendor, such as the vendor of a software interface, such as a dedicated App, that runs on the local computing apparatus 22.

Figure 2:
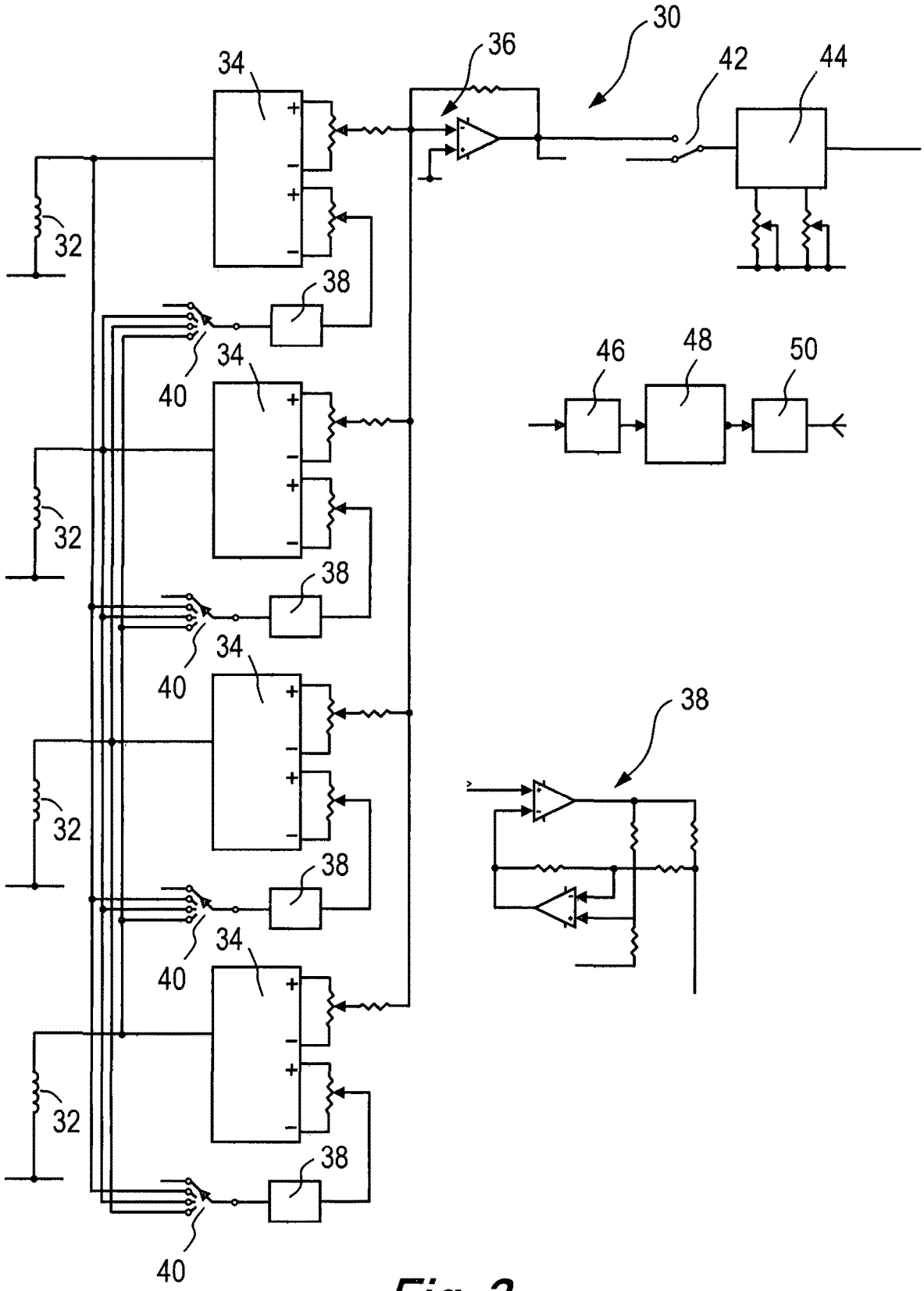
FIG. 2 is a block diagram representation of the mixer apparatus of FIG. 1.

A block diagram representation of the mixer apparatus of FIG. 1 is shown in FIG. 2. The mixer apparatus 30 of FIG. 2 comprises four magnetic pickups 32 which are comprised in an electric guitar such as the electric guitar 10 of FIG. 1. A first end of the coil of each of the four magnetic pickups 32 is connected to a circuit common and in the present configuration to a zero volt line. The mixer apparatus 30 also comprises four input circuits 34 which are each electrically connected to a second end of the coil of a respective one of the four magnetic pickups 32 whereby the input circuit receives an audio signal generated by the magnetic pickup when the electric guitar is played. As described in more detail below, each input circuit 34 provides two audio output signals. The mixer apparatus 30 further comprises an audio mixer which comprises a summing circuit 36. The mixer apparatus 30 yet further comprises a voltage to current converter 38 and a switch arrangement 40 for each of the four input circuits 34. As described in more detail below, the summing circuit 36 receives one of the two audio output signals from each of the four input circuits 34 and sums the received four audio output signals. Each voltage to current converter 38 receives the other of the two audio output signals from a respective one of the four input circuits 34. FIG. 2 shows in inset a detailed schematic for the voltage to current converter 38. The detailed schematic for the voltage to current converter 38 is described below with reference to FIG. 3. Each switch arrangement 40 receives a current signal from a respective one of the four voltage to current converters 38 and selectively applies the received current signal to the second end of the coils of the four magnetic pickups 32.

The mixer apparatus 30 also comprises an equalizer switch 42 which is operable under digital control to switch a parametric equalizer in and out of operation. The parametric equalizer is of known form and function with its parameters being set by digital potentiometers either directly or by way of the I2C bus mentioned below. The mixer apparatus 30 further comprises a gain stage 44 which is operative directly on the output from the summing circuit 36 or is operative on the output from the summing circuit after processing by the parametric equalizer when the parametric equalizer has been selected for operation by the equalizer switch 42. The gain stage 44 is described in more detail below with reference to FIG. 3. The mixer apparatus 30 yet further comprises a peak detector circuit, an analogue-to-digital converter 46, an embedded microcontroller 48 and a Bluetooth or WiFi transceiver 50. The analogue-to-digital converter 46, the embedded microcontroller 48 and the Bluetooth or WiFi transceiver 50 are of conventional form and function except as described herein. The peak detector circuit is shown in FIG. 4 but not shown in FIG. 1 although it is comprised in the mixer apparatus 30. The output from summing circuit 36 is received as an input by the peak detector circuit. An output from the peak detector circuit is received in the analogue-to-digital converter 46 to thereby provide a digital representation of a sampled peak value. The digital representation of the sampled peak value is received in the embedded microcontroller 48 and is processed to determine if the output from the audio signal mixer should be amplified or attenuated by way of the gain stage 44. The gain of the gain stage 44 is controlled digitally by the embedded microcontroller 48 in dependence on the determination. Digital control of the input circuits 34, the switch arrangements 40, the equalizer switch 42 and the gain stage 44 is by the embedded microcontroller 48 either directly or by way of a bus, such as an I2C bus. The embedded microcontroller 48 is further operative to control the Bluetooth or WiFi transceiver 50 to provide for communication between the circuitry of the mixer apparatus 30 and the local computing apparatus 22.

Figure 3:
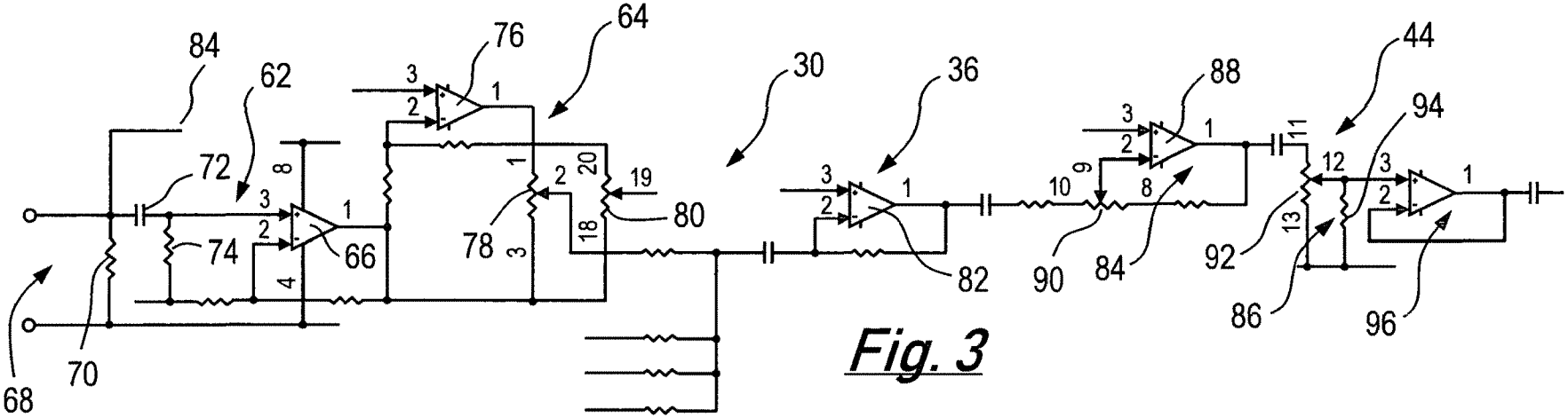
FIG. 3 is a schematic of an input circuit, audio signal mixer and gain stage of the mixer apparatus.
Figure 4:
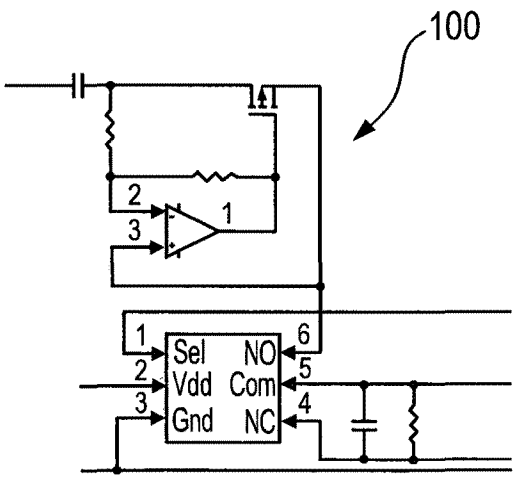
FIG. 4 is a schematic of a peak detector circuit.

A schematic of part of the mixer apparatus 30 of FIG. 2 containing one of the input circuits, the audio signal mixer and the gain stage is shown in FIG. 3. Each input circuit comprises a first input circuit amplifier 62 and a second input circuit amplifier 64. The first input circuit amplifier 62 comprises an op-amp 66 in a non-inverting amplifier configuration having substantially unity gain. The first input circuit amplifier 62 is therefore operative as a voltage buffer. The input circuit also comprises an audio signal input 68 which is connected to one end of the coil of a magnetic pickup 32 with the current return path connected to the other end of the coil and defining a zero volt circuit common. The input circuit further comprises an input circuit resistor 70 in parallel with the coil of the magnetic pickup 32 and a series capacitor 72 and parallel resistor 74 (which constitutes an input circuit impedance element) at the input to the op-amp 66. The live end of the coil (i.e. the end other than the end at circuit common) is connected to the non-inverting input of the op-amp 66. The first input circuit amplifier 62 thus provides a linear active circuit in a signal path between the live end of the input circuit resistor 70 and the input to the second input circuit amplifier 64. The input circuit resistor 70, the series capacitor 72 and the parallel resistor 74 place both input terminals of the op-amp 66 at zero volts but deliver the signal from the magnetic pickup to the op-amp 66 referenced to 2.5 volts. The parallel resistor 74 is the main determinant of input impedance although input circuit resistor 70 does contribute to input impedance. This is because the input circuit resistor is of much higher value than the parallel resistor. The input circuit resistor 70 is present to charge the series capacitor 72 to 2.5 volts at switch on whether or not a magnetic pickup 32 is connected whereby the end of the magnetic pickup at circuit common is at the same potential as circuit common of the mixer apparatus. The return path of the power supply to the op-amp 66 is connected to the zero volt circuit common with the inputs to the op-amp being referred to a circuit common at a voltage mid-way between the power supply voltage and zero volts.

The second input circuit amplifier 64 comprises an op-amp 76 in a unity gain inverting amplifier configuration. The second input circuit amplifier 64 receives the output from the first input circuit amplifier 62 at its inverting input. The input circuit therefore provides two buffered voltage signals which each correspond substantially to the audio signal received at the audio signal input with a first one of the two buffered voltage signals being non-inverted and a second one of the two buffered voltage signals being inverted.

Each input circuit yet further comprises a first digital potentiometer 78 (which constitutes a first phase mixer circuit) which is connected at one end to the output from the first input circuit amplifier 62 and is connected at the other end to the output from second input circuit amplifier 64. The 'wiper' of the first digital potentiometer 78 provides an input to the summing circuit. The first digital potentiometer 78 is digitally controlled by the embedded microcontroller 48 to move the 'wiper' whereby the 'wiper' provides an output which corresponds at one end of movement to the non-inverted output from the first input circuit amplifier 62 and at the other end of movement to the inverted output from the second input circuit amplifier 64. When the 'wiper' is at its mid-point, the outputs from the first and second input circuit amplifiers 62, 64 cancel each other whereby a signal from the magnetic pickup 32 connected to the present input circuit is not applied to the summing circuit. As the 'wiper' moves above its mid-point location, the 'wiper' provides an output of changing proportions of outputs from the first and second input circuit amplifiers 62, 64 with the output from the second, inverting circuit amplifier 64 predominating. As the 'wiper' moves below its mid-point location, the 'wiper' provides an output of changing proportions of outputs from the first and second input circuit amplifiers 62, 64 with the output from the first, non-inverting circuit amplifier 62 predominating.

The summing circuit 36 comprises an op-amp 82 in a unity gain summing amplifier configuration. The summing circuit 36 receives an input from the 'wiper' of the first digital potentiometer 78 of each of the plural input circuits whereby the output from the summing circuit is a voltage analogue of the summed current signals generated by the coils of the magnetic pickups 32. The mixer apparatus 30 thus provides a series emulation mode.

Each input circuit further comprises a second digital potentiometer 80 (which constitutes a second phase mixer circuit) which is connected at one end to the output from the first input circuit amplifier 62 and is connected at the other end to the output from second input circuit amplifier 64. The 'wiper' of the second digital potentiometer 80 provides an input to the voltage to current converter 38 shown in FIG. 2. Otherwise, the second digital potentiometer 80 is configured as described above with reference to the first digital potentiometer 78. The 'wiper' of the second digital potentiometer 80 therefore provides an output comprising changeable proportions of outputs from the first and second input circuit amplifiers 62, 64. The voltage signal at the output from the second digital potentiometer 80 is converted to a floating current signal analogue by way of the voltage to current converter 38. The voltage to current converter 38 is in the form of a Howland current pump having a two op-amp configuration. A first op-amp of the Howland current pump is in the forward path with the second op-amp of the Howland current pump being in the feedback loop. Each input circuit also comprises the switch arrangement 40 shown in FIG. 2 to which the output from the voltage to current converter 38 is applied as an input. The switch arrangement 40 is digitally controlled by the embedded microcontroller 48 to apply the current signal to none or a selected one of the other input circuits. The current signal is applied at the live end 84 of the input circuit resistor 70 of an input circuit whereby current signals from two or more magnetic pickups are summed. The second digital potentiometer 80, the voltage to current converter 38 and the switch arrangement 40 of each of the input circuits therefore provide a parallel emulation mode.

The gain stage 44 of the mixer apparatus 30 will now be described. The gain stage 44 receives an audio voltage signal from the output of the summing circuit 36. The gain stage 44 comprises a first variable gain circuit 84 and a second variable gain circuit 86. The first variable gain circuit 84 comprises an op-amp 88 configured as an inverting amplifier. The first variable gain circuit 84 further comprises a third digital potentiometer 90 with a first end of the third digital potentiometer in a feedback loop of the op-amp 88, a second end of the third digital potentiometer connected to a resistor in series with an inverting input of the op-amp 88, and a 'wiper' of the third digital potentiometer connected to the inverting input of the op-amp 88. The third digital potentiometer is digitally controlled by the embedded microcontroller 48. The first variable gain circuit 84 is configured by way of selection of resistance values to provide for fine volume control, such as between −12 dBV and +12 dBV.

The second variable gain circuit 86 receives an audio voltage signal from the first variable gain circuit 84. The second variable gain circuit 86 has the form of a variable voltage divider. The variable voltage divider comprises a fourth digital potentiometer 92 which is digitally controlled by the embedded microcontroller 48. A first end of the fourth digital potentiometer 92 is connected to an output from the first variable gain circuit 84 and a second end of the fourth digital potentiometer is connected to the mid-rail common. A 'wiper' of the fourth digital potentiometer 92 provides an output from the variable voltage divider. The variable voltage divider further comprises a voltage divider resistor 94 between the 'wiper' of the fourth digital potentiometer 92 and the mid-rail common to thereby make operation of the variable voltage divider non-linear. The second variable gain circuit 86 is configured by way of selection of appropriate resistance values to provide for coarse volume control. The mixer apparatus 30 further comprises a voltage follower 96 at the output from the second variable gain circuit 86.

The mixer apparatus 30 comprises the peak detector circuit 100 shown in FIG. 4. The mixer apparatus 30 receives an output from the summing circuit 36 as an input. The peak detector circuit 100 is digitally controlled by the embedded microcontroller 48 to sample and hold peak signals and to reset at an interval of milliseconds appropriate to the bandwidth of the audio signal. The peak detector circuit 100 is of known design. FIG. 4 shows an example of peak detector circuit. The output from the peak detector circuit 100 is received in the analogue-to-digital converter 46 to thereby provide a digital representation of a sampled peak value. The digital representation of the sampled peak value is processed in the embedded microcontroller 48 to determine if the output from the summing circuit 36 should be amplified or attenuated and, if so, an extent of amplification or attenuation to thereby provide automatic signal level control. The embedded microcontroller 48 then controls the gain of the gain stage 44 by way of control of the third and fourth digital potentiometers 90, 92. As described above, control is either direct from the embedded microcontroller 48 or by way of a bus, such as an I2C bus.

The mixer apparatus 30 comprises active electronic components, such as the op-amps 66, 76, 82, 88, which are put selectively into a low power state by either cutting their power supply or by digital control where such active electronic components are configured of themselves to enter a low power mode. The mixer apparatus is configured to put such active electronic components into the low power state when no signal or when a signal no greater than a predetermined threshold is received from any musical instrument pickup over a predetermined period. Although not shown in the drawing, the mixer apparatus 30 comprises a wake-up circuit which changes such active electronic components from the low power state to an operative state. The wake-up circuit comprises an amplifier, such as an op-amp based amplifier, which receives an output from at least one of the musical instrument pickups 32 as an input and provides an output to the embedded microcontroller 48. The embedded microcontroller 48 performs threshold detection on the wake-up circuit input with active electronic components which have been put into the low power state being powered up under control of the embedded microcontroller in dependence on an outcome of the threshold detection.

Figure 5:
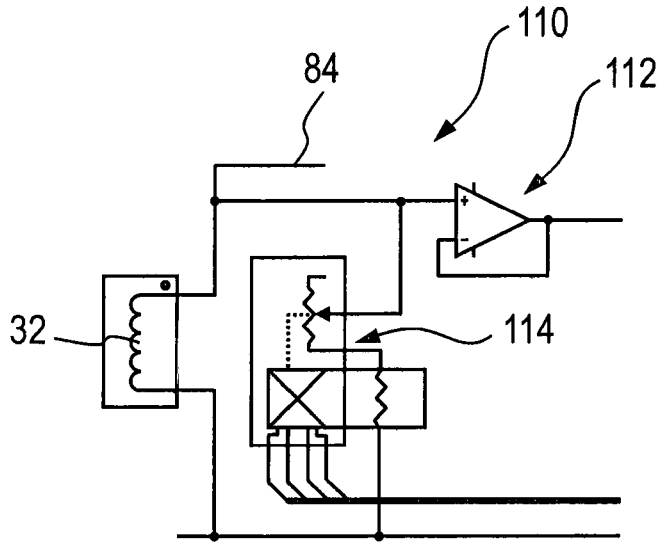
FIG. 5 is a schematic of an alternative embodiment of input circuit.

A schematic of an alternative embodiment of input circuit 110 is shown in FIG. 5. The input circuit 110 of FIG. 5 is as described above with reference to FIGS. 2 and 3 except as will now be described. The first input circuit amplifier 112 of the embodiment of FIG. 5 is a unity gain non-inverting amplifier. The input circuit resistor 70 of the embodiment of FIG. 3 is replaced in the embodiment of FIG. 5 with a digitally controlled variable resistor 114. The variable resistor 114 is controlled by the embedded microcontroller 48 to change the input impedance and thereby change the damping characteristic. Changing the damping characteristic changes the tonal characteristics of the signal from the magnetic pickup 32.

Figure 6:
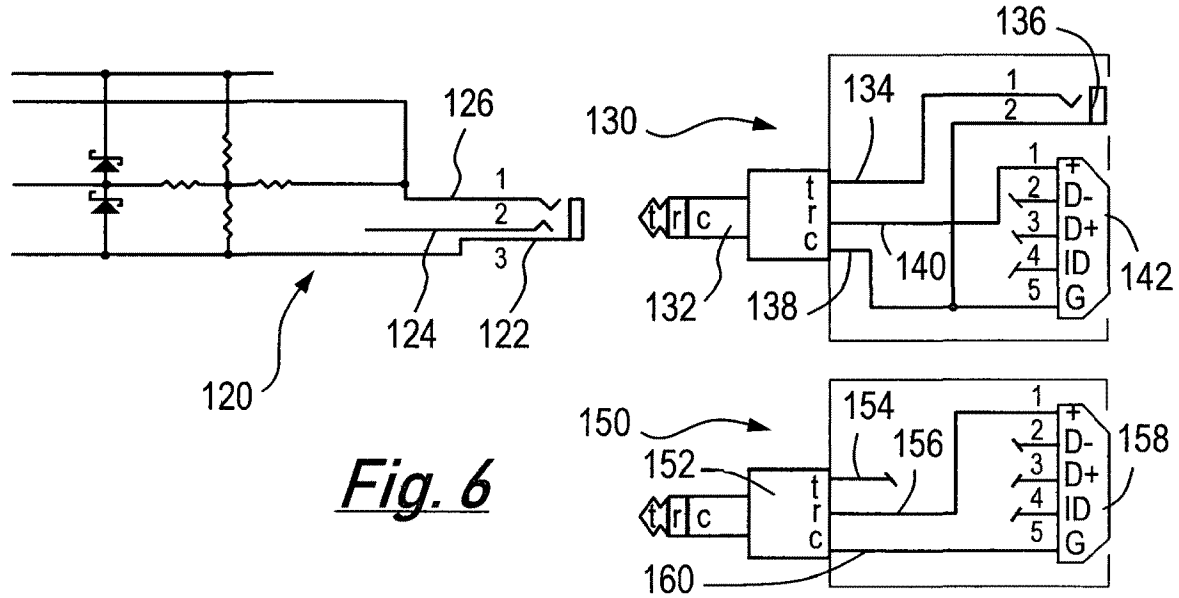
FIG. 6 is a schematic of a connector arrangement for the mixer apparatus.

A schematic of a connector arrangement for the mixer apparatus is shown in FIG. 6. As shown in FIG. 1, the mixer apparatus 12, 30 is electrically connected by way of a lead 16 to the like of a power amplifier 18. The connection is made by way of a jack socket comprised in the mixer apparatus 12, 30 and a mono jack plug on the end of the lead 16. The jack socket 120 comprised in the mixer apparatus 12, 30 is of stereo form with the chassis terminal 122 connected to the zero volt circuit common, the tip terminal 124 connected to the audio output signal from the mixer apparatus (i.e. the output from the gain stage 44) and the ring terminal 126 providing a battery charging current for recharging the battery comprised in the mixer apparatus 12, 30. The jack socket 120 therefore provides an outgoing path for the audio output signal and incoming path for the battery charging current with the two paths sharing a circuit common return path.

The connector arrangement also comprises a first adaptor 130. The first adaptor 130 is terminated with a stereo jack plug 132 which is received in the stereo jack socket 120. The tip terminal 134 of the stereo jack plug 132 is connected to the tip terminal of a mono jack socket 136 and the chassis terminal 138 of the stereo jack plug is connected to the chassis terminal of the mono jack socket. The mono jack plug on the end of the lead 16 is plugged into the mono jack socket 136 of the first adaptor 130. The ring terminal 140 of the stereo jack plug 132 is connected to a first terminal of a micro-USB socket 142 and the chassis terminal 138 of the stereo jack plug is connected to a second terminal of the micro-USB socket. A micro-USB plug on a lead from a power supply is plugged into the micro-USB socket 142 with the corresponding terminals of the micro-USB plug carrying a charging current. The first adaptor 130 thus provides for recharging of the battery while the mixer apparatus 12, 30 is being used.

The connector arrangement also comprises a second adaptor 150. The second adaptor 150 is terminated with a stereo jack plug 152 which is received in the stereo jack socket 120 of the mixer apparatus. The tip terminal 154 of the stereo jack plug 152 is not connected. The ring terminal 156 of the stereo jack plug 152 is connected to a first terminal of a micro-USB socket 158 and the chassis terminal 160 of the stereo jack plug is connected to a second terminal of the micro-USB socket. A micro-USB plug on a lead from a power supply is plugged into the micro-USB socket 158 with the corresponding terminals of the micro-USB plug carrying a charging current. The second adaptor 150 thus provides for recharging of the battery while the mixer apparatus 12, 30 is not being used.

As described above, the mixer apparatus is in different respects under digital control by the embedded microcontroller 48. The embedded microcontroller 48 also interfaces by way of a Bluetooth or WiFi communication channel with the local computing apparatus 22 shown in FIG. 1. The local computing apparatus 22 runs a software interface in the form of an App which provides user control of the mixer apparatus 12, 30 and feedback from the mixer apparatus to the user. The App provides for control of the first and second digital potentiometers 78, 80, the switch arrangements 40 and the variable resistors 114. Control of the mixer apparatus is by way of an interactive graphical user interface provided on a touchscreen display of the local computing apparatus 22. A representation of the touchscreen display 180 is shown in FIG. 7.

A user of the local computing apparatus 22 creates a user account with the central computing apparatus 24 to provide full access to the App and functionality of the mixer apparatus 12. 30. Creation of a user account and access to the user account is in accordance with known practice. Thereafter, the user has access to plural different electric guitar configurations which are stored in the central computing apparatus 24. The user selects an appropriate one of the plural different electric guitar configurations from a drop-down list shown on the display 180. The user then takes a photograph of the actual electric guitar 10 which is to be used with the mixer apparatus 12, 30 by way of a camera comprised in the local computing apparatus 22. The taking of a photograph is aided by the App providing an outline of the selected electric guitar on the display 180 of the local computing apparatus whereby the user can position the local computing apparatus such that the displayed outline is in registration with an image of the actual electric guitar acquired by the local computing apparatus and displayed on the display. When the user is happy with the composition of the image acquired by the camera, the user operates the local computing apparatus to store an image of the actual electric guitar. The stored image is processed by the App to abstract a colour scheme of the guitar and to incorporate the abstracted colour scheme in a representative image of the selected electric guitar which is received in the local computing apparatus 22 from the central computing apparatus 24. The representative image is thus personalised.

Figure 7:
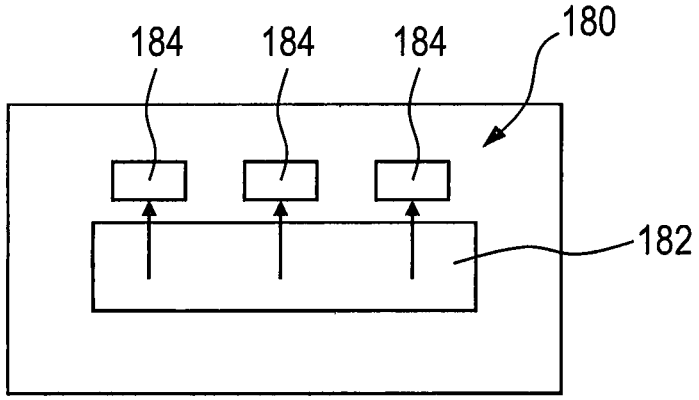
FIG. 7 is a representation of a display of the local computing apparatus.

As shown in FIG. 7, the App is then operative to present the representative image 182 of the elected electric guitar on the display 180. The pickups 184 comprised in the representative image are shown as larger relative to the rest of the guitar than in the actual guitar. Furthermore, the pickups 184 are displayed such that they float above their location on the actual guitar as indicated by the arrows present in FIG. 7. Each of the pickups 184 in the representative image is an object which is manipulable by a user independently of the rest of the representative image. The App translates different forms of manipulation of the pickup objects into different control data for controlling the mixer apparatus 12, 30. For example, tapping a pickup object switches between a pickup being selected and deselected. By way of further example, changing the shape of the pickup object, such as stretching or contracting the object along at least one of two orthogonal axes, controls gain at the input to the corresponding input circuit. By way of yet further example, rotation of a pickup object controls at least one of the first and second digital potentiometers 78, 80. Series emulation, parallel emulation and gain for each pickup may thus be controlled.

A guitar usually comprises plural manually operable controls, such as a switches and control knobs. When the mixer apparatus is brought into use, the manually operable controls are electrically connected to inputs to the mixer apparatus. Where a manually operable control is a switch, the input to the mixer apparatus is received at a digital input to the embedded microcontroller 48. Where a manually operable control is a control knob, the input to the mixer apparatus is received by an analogue-to-digital converter and the converted digital input is then received in the embedded microcontroller 48. The inputs received in the embedded microcontroller 48 are used by way of firmware running on the embedded microcontroller to provide for control of the mixer apparatus, such as in respect of master volume and master tone.

In a form of the invention, the mixer apparatus comprises an illuminated rotary encoder (which constitutes a primary manually operable control). The illuminated rotary encoder is an EC12PLRGBSDVBF-D-25K-24-24C from Top-Up Industry Corp. of 8F, No. 189, Yung An Road, Taoyuan, Taiwan 33054. In use, the illuminated rotary encoder replaces a control knob comprised in the guitar upon manufacture. Alternatively, the illuminated rotary encoder is incorporated in the guitar upon manufacture. The illuminated rotary encoder is electrically coupled to the embedded microcontroller 48 with the embedded microcontroller being configured by way of firmware to make selections from predetermined configurations (or patches) for the guitar in dependence on the position of the illuminated rotary encoder.

The mixer apparatus provides for a wide range of different settings. The App provides for storage and naming of each setting. Furthermore, stored settings are conveyed by way of the above described user account for storage on the central computing apparatus 24 from where they may be retrieved by the user for subsequent use. According to another application, the operator of the central computing apparatus 24 forms a library of reference audio files for different makes and models of electric guitar. Each reference audio file is formed by recording the sound of a particular make and model of electric guitar when, for example, the guitar is strummed on all strings concurrently and open chord. The user records in a personal audio file the sound of his or her guitar when strummed in the same fashion. The user also selects a particular make and model of electric guitar by way of the App. The App is operative to compare, such as by way of correlation, the reference audio file for the elected guitar and the personal audio file and to determine how to make the audio signal from the user's guitar sound like the selected guitar. The App then forms a reference configuration in dependence on this determination and downloads the reference configuration to the embedded microcontroller 48 which then controls the mixer apparatus 12, 30 accordingly.

In a further application, user account data comprised in the central computing apparatus 24 comprises a unique code, such as a MAC address or IMEI number, for the local computing apparatus 22 of each of plural mixer apparatus 12, 30 operating with the central computing apparatus. The unique code provides for identification of each of the mixer apparatus 12, 30. The user account data further comprises information relating to the electric guitar with which the mixer apparatus 12, 30 is operable. The information relating to the electric guitar comprises the like of a photograph of the electric guitar and a photograph of documents serving as proof of ownership of the electric guitar, such as a purchase receipt. The user account data therefore serves to provide proof of ownership of the electric guitar. The central computing apparatus 24 is configured to regulate transfer of ownership of the electric guitar by controlling access to the user account by the present and future owners. Such an approach is useful where the seller and buyer are remote from each other. More specifically, the process involves the seller sending the electric guitar to the buyer and the seller retaining control of the user account until payment for the electric guitar clears whereupon control of the user account is passed to the buyer.

In a further application, the mixer apparatus provides a 'find my guitar' function. As described above, communication between the local computing apparatus 22 and the electronic circuitry of the mixer apparatus 12, 30 is by way of a Bluetooth or WiFi communication channel. In this further application, the local computing apparatus 22 and the electronic circuitry of the mixer apparatus 12, 30 are configured for periodic wireless communication between the local computing apparatus and the electronic circuitry of the mixer apparatus whereby presence of the electronic circuitry of the mixer apparatus and hence the electric guitar can be determined. If the electric guitar and hence the electronic circuitry of the mixer apparatus is moved, the local computing apparatus is operative to determine that there has been no periodic wireless communication and to generate an alarm in dependence on this determination. The alarm may be output by at least one of the local computing apparatus 22 and the central computing apparatus 24. The App provides for selection between generation of an alarm being enabled and generation of an alarm being disabled with, for example, the former being an 'away from home' mode and the latter being an 'at home mode'.

The App provides security of access features. The App is optionally configured by a user to require full access to the App upon entry of a password. The password is entered by manipulation of the image objects 184 of FIG. 7 in a predetermined fashion. Further to this, the App generates an unauthorised access attempt notification after a predetermined number of failed attempts to enter the password whereby the App is locked and the central computing apparatus 24 is notified accordingly. Unlocking of the App is by way of communication by the user with the operator of the central computing apparatus 24 in accordance with procedures of known form.

The invention claimed is:

1. A mixer apparatus for mixing audio signals from a musical instrument, comprising:

plural input circuits, each of the plural input circuits having an audio signal input which, in use, is coupled electrically with and thereby receives an audio signal from a different one of plural musical instrument pickups for the musical instrument; and an audio signal mixer receiving audio signals from the plural input circuits and mixing the received audio signals with one another, wherein each of the plural input circuits comprises a linear active circuit in an audio signal path between the audio signal input and the audio signal mixer, wherein each of the plural input circuits comprises a first input circuit amplifier operative as a buffer amplifier to present a high impedance to the different one of the plural musical instrument pickups, the first input circuit amplifier comprising the linear active circuit, wherein each of the plural input circuits further comprises a second input circuit amplifier which receives an audio signal from the audio signal input and provides a second audio signal output which is the other of inverted and not inverted when the first input circuit amplifier provides a first audio signal output which is one of inverted and not inverted, and wherein each of the plural input circuits further comprises a phase mixer circuit which receives the first and second audio signal outputs and provides a phase mixer circuit output signal which is a combination of the first and second audio signal output signals, the audio signal mixer receiving the phase mixer circuit output signal from each of the plural input circuits and mixing the plural received phase mixer circuit output signals with one another.

2. The mixer apparatus of claim 1, wherein the mixer apparatus comprises the plural musical instrument pickups.

3. The mixer apparatus according to claim 2, wherein each of the plural musical instrument pickups comprises a current output sensor and is a one port device having first and second output terminals, the first output terminal being electrically connected to the audio signal input and the second output terminal being electrically connected to a circuit common defined by the mixer apparatus, each input circuit comprising an input circuit impedance element between the audio signal input and the circuit common, a current signal provided by the current output sensor being developed as a voltage signal across the input circuit impedance element, an impedance of the input circuit impedance element being digitally controlled.

4. The mixer apparatus of claim 1, wherein the linear active circuit of each of the plural input circuits has a substantially linear transfer function.

5. The mixer apparatus of claim 1, wherein the first input circuit amplifier is configured as a non-inverting amplifier having substantially unity gain, the second input circuit amplifier is configured as an inverting amplifier having substantially unity gain, and the second input circuit amplifier receives an audio signal from an output from the first input circuit amplifier whereby the second input circuit amplifier receives the audio signal from the audio signal input by way of the first input circuit amplifier.

6. The mixer apparatus of claim 1, wherein the phase mixer circuit comprises a digital potentiometer which is digitally controlled to change the relative proportions in the phase mixer circuit output signal of the audio signals from the first and second input circuit amplifiers.

7. The mixer apparatus of claim 6, wherein one end of the digital potentiometer is connected to the output from the first input circuit amplifier and another end of the digital potentiometer is connected to the output from second input circuit amplifier, a wiper of the digital potentiometer providing the phase mixer circuit output signal.

8. The mixer apparatus of claim 1, wherein the audio signal mixer comprises a summing circuit which receives the phase mixer circuit output signal from each of the plural phase mixer circuits and sums the plural received phase mixer circuit output signals to thereby mix the plural received phase mixer circuit output signals with one another.

9. The mixer apparatus of claim 8, wherein the summing circuit comprises a summing circuit amplifier operative as a buffer amplifier to thereby present a high impedance to each input circuit.

10. The mixer apparatus of claim 8, further comprising a gain stage which receives an audio signal from the summing circuit, the gain stage comprising a first variable gain circuit comprising an amplifier and having a digitally controlled gain and which receives the audio signal from an output of the summing circuit.

11. The mixer apparatus of claim 10, wherein the gain stage further comprises a second variable gain circuit which receives an audio signal from an output of the first variable gain circuit, the second variable gain circuit comprising a digitally controlled variable voltage divider.

12. The mixer apparatus of claim 10, further comprising a peak detector circuit, an analogue-to-digital converter and a processor, an output from the audio signal mixer being received as an input by the peak detector circuit, an output from the peak detector circuit being received as an input to the analogue-to-digital converter to thereby provide a digital representation of a sampled peak value, the digital representation of the sampled peak value being processed in the processor to determine if the output from the audio signal mixer should be amplified or attenuated, and the gain of the gain stage being digitally controlled in dependence on the determination made by the processor.

13. The mixer apparatus according to claim 1 further comprising an audio signal output connector electrically coupled to an output from the mixer apparatus, the audio signal output connector being configured to connect the mixer apparatus to a power amplifier by way of a lead.

14. The mixer apparatus according to claim 1 further comprising a hand-portable computing apparatus providing a software interface which digitally controls the mixer apparatus, digital control of the mixer apparatus being effected by wireless communication between the hand-portable computing apparatus and electronic circuitry of the mixer apparatus.

15. A musical instrument comprising the mixer apparatus according to claim 1 and the plural musical instrument pickups.

16. A method of mixing audio signals from a musical instrument, the method comprising:

receiving in each of plural input circuits an audio signal at an audio signal input of the input circuit from a different one of plural musical instrument pickups for the musical instrument;

receiving audio signals from the plural input circuits in an audio signal mixer; and mixing the received audio signals with one another in the audio signal mixer, wherein each of the plural input circuits comprises a linear active circuit in an audio signal path between the audio signal input and the audio signal mixer, wherein each of the plural input circuits comprises a first input circuit amplifier operative as a buffer amplifier to present a high impedance to the different one of the plural musical instrument pickups, the first input circuit amplifier comprising the linear active circuit, wherein each of the plural input circuits further comprises a second input circuit amplifier which receives an audio signal from the audio signal input and provides a second audio signal output which is the other of inverted and not inverted when the first input circuit amplifier provides a first audio signal output which is one of inverted and not inverted, and wherein each of the plural input circuits further comprises a phase mixer circuit which receives the first and second audio signal outputs and provides a phase mixer circuit output signal which is a combination of the first and second audio signal output signals, the audio signal mixer receiving the phase mixer circuit output signal from each of the plural input circuits and mixing the plural received phase mixer circuit output signals with one another.

* * * * *